United States Patent [19]

Maeda

[11] 3,951,365

[45] Apr. 20, 1976

[54] RAIL CROSSOVER ARRANGEMENT

[75] Inventor: Kazuo Maeda, Chiba, Japan

[73] Assignee: Mitsui Shipbuilding & Engineering Co., Ltd., Tokyo, Japan

[22] Filed: Oct. 11, 1974

[21] Appl. No.: 514,070

Related U.S. Application Data

[63] Continuation of Ser. No. 335,589, Feb. 26, 1973, abandoned.

[52] U.S. Cl. ..... 246/465

[51] Int. Cl.[2] ..... E01B 7/18

[58] Field of Search.... 246/465, 466, 273, 375–381, 246/111; 238/151

[56] References Cited

UNITED STATES PATENTS

| | | | |
|---|---|---|---|
| 768,518 | 8/1904 | Coughlan | 246/465 |
| 792,068 | 6/1905 | Oliver | 246/465 |
| 856,766 | 6/1907 | Clement | 246/465 |
| 897,169 | 8/1908 | Smith | 246/465 |
| 1,811,129 | 6/1931 | Hesskew et al. | 246/465 |

*Primary Examiner*—M. H. Wood, Jr.
*Assistant Examiner*—Richard A. Bertsch
*Attorney, Agent, or Firm*—Howson and Howson

[57] ABSTRACT

Rail crossover arrangement characterized in that wheels can pass through the crossover without shock. To this end flanged portions of the wheels are supported on the crossover plate provided in the intersections of the rails when the wheels pass through the intersections.

2 Claims, 3 Drawing Figures

RAIL CROSSOVER ARRANGEMENT

This is a continuation of application Ser. No. 335,589 field 2/26/73, now abandoned.

This invention relates to an improvement in the arrangement of crossovers of rails for railway vehicles.

An object of the invention is to obtain a rail crossover arrangement that allows passage of a heavy-weighted vehicle over a crossover with minimum shock.

To this end according to the present invention a crossover plate is provided at each intersection of rails; each rail is spaced from the crossover plate to account for thermal expansion, and the crossover plate is so arranged that the flanged portion of the wheel of the vehicle may ride over the plate.

The invention is now described in further detail with reference to the drawings.

Figure 1:
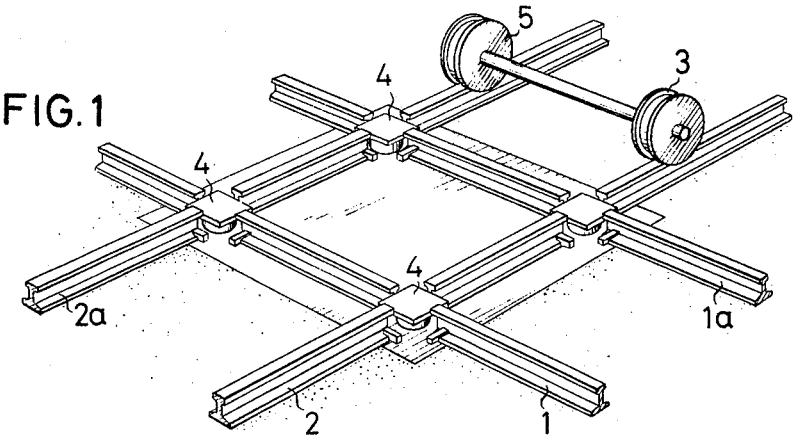
FIG. 1 is a perspective view of the crossover arrangement according to the present invention.
Figure 2:
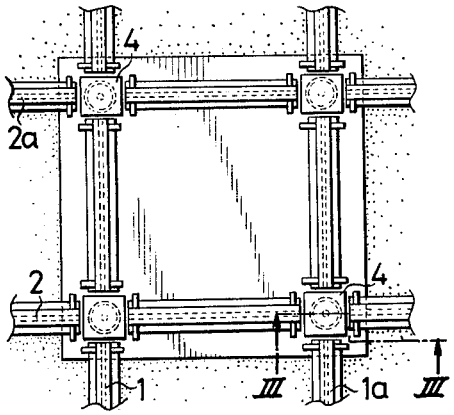
FIG. 2 is a plan view thereof.
Figure 3:
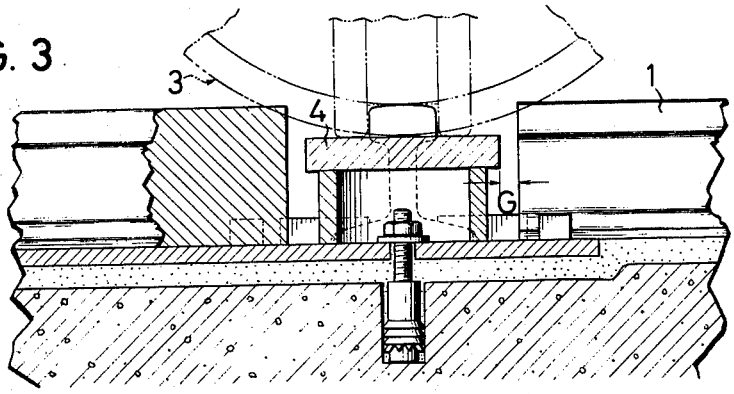
FIG. 3 is a sectional view taken along the line III — III of FIG. 2.

The rails 1, 1*a* and 2, 2*a* which cross each other at right angles are cut out at the intersection portions for a length greater than the width of the wheel 3, and a crossover plate 4 is located in each intersection. As shown in FIG. 3, the top of each crossover plate 4 tangentially engages and supports the bottom of the flange 5 of the wheel, each rail is spaced by a gap G from the crossover plate to account for thermal expansion.

Thus, according to this arrangement, when the wheel 3 passes the crossover of rails, it can smoothly run across the crossover without shock by the gap G as its flanges are supported and guided by the crossover plates when the treads of wheels pass through the gap G.

What is claimed:

1. In combination with a rail crossover for use with a vehicle wheel having a tread and at least one flange: a cut-out common to each of a pair of intersecting rails of said crossover and aligned with each of them at the point of their intersection, said cut-out dividing each of said pair of rails into adjacent sections such that each section of each rail is thereby separated from each of the other three rail sections; and a cross-over plate in said cut-out, said plate having a substantially flat top positioned below the tops of said adjacent sections by a distance substantially the same as the height of said flange measured from its tread, said flat top extending laterally over and beyond the regions traversed by said flange as said wheel traverses said cut-out along either of said rails, thereby to support said wheel on its flange as it traverses said flat top of said plate and to maintain said wheel at substantially the same height as when said wheel is traversing either of said rails on its tread.

2. The arrangement of claim 1, in which said plate is spaced from each of said rail sections by a distance smaller than the thickness of said flange.

* * * * *